United States Patent [19]

Reschly

[11] 4,326,469

[45] Apr. 27, 1982

[54] MULTI-FUEL FEEDER DISTRIBUTOR

[75] Inventor: David C. Reschly, Monroe, Mich.

[73] Assignee: Detroit Stoker Company, Monroe, Mich.

[21] Appl. No.: 90,560

[22] Filed: Nov. 2, 1979

[51] Int. Cl.[3] ..... F23K 3/18

[52] U.S. Cl. ..... 110/115; 110/104 R; 110/292; 414/174

[58] Field of Search ..... 414/174, 193, 195; 110/102, 104 R, 115, 105, 182.5, 346, 101 R, 292

[56] References Cited

U.S. PATENT DOCUMENTS

| | | | |
|---|---|---|---|
| Re. 21,617 | 11/1940 | Larsen . | |
| 261,864 | 8/1882 | Mason . | |
| 542,477 | 7/1895 | Jenkins | 110/102 |
| 815,929 | 3/1906 | Matcham . | |
| 966,547 | 8/1910 | Hervey . | |
| 1,504,528 | 8/1924 | Strandrud | 110/102 |
| 1,630,509 | 5/1927 | Adams . | |
| 1,977,644 | 10/1934 | Paxton | 110/346 X |
| 2,029,725 | 2/1936 | Kuhner | 110/346 X |
| 2,130,329 | 9/1938 | Sammons . | |
| 2,183,648 | 12/1939 | Johnson . | |
| 2,228,751 | 1/1941 | Bros . | |
| 2,257,693 | 9/1941 | Kohout . | |
| 2,654,331 | 10/1953 | Mosshart . | |
| 2,692,642 | 10/1954 | Leach . | |
| 2,735,384 | 2/1956 | Kohout | 110/104 R |
| 3,241,506 | 3/1966 | Miner, Jr. . | |
| 3,489,110 | 1/1970 | Miller . | |
| 4,054,097 | 10/1977 | Barkhuus . | |
| 4,056,069 | 11/1977 | Marshal . | |
| 4,109,590 | 8/1978 | Mansfield . | |
| 4,143,603 | 3/1979 | Martin et al. . | |

FOREIGN PATENT DOCUMENTS

| | | | |
|---|---|---|---|
| 2812552 | 9/1979 | Fed. Rep. of Germany | 110/182.5 |

*Primary Examiner*—Edward G. Favors

*Attorney, Agent, or Firm*—Harness, Dickey & Pierce

[57] ABSTRACT

A multi-fuel feeder distributor for a stoker capable of feeding into a furnace and distributing over a grate or hearth, coal and a second fuel, such as wood or a waste fuel, either in combination or separately, comprising a coal feed and a second fuel feed having outlet spouts discharging into a single feed throat into the furnace. Coal is fed from a coal hopper at a continuous controlled rate to a distributor portion of the coal feeder which mechanically throws the coal into the furnace and distributes it evenly over the entire grate surface. The second feeder, an air swept waste fuel feeder, may be used at the same time to feed waste fuel in combination with the coal without interfering with the operation of the coal feed. Water-cooling is used at the feed throat along the furnace wall. The waste fuel feeder further comprises: a counterbalanced damper extending across the feed chute of the feeder to aid in distributing the fuel across the width of the chute and serve as a back draft damper to prevent blow back from the furnace, with the added capability of being locked in a position to form a narrow venturi throat to feed fine fuels; an air discharge slot at the discharge point to improve distribution of the fuel; and a rotary damper to provide varying air flow having an additional side damper to allow for variable minimum air flow when the rotary damper is in a position of minimum air flow.

30 Claims, 8 Drawing Figures

FIG. 4.
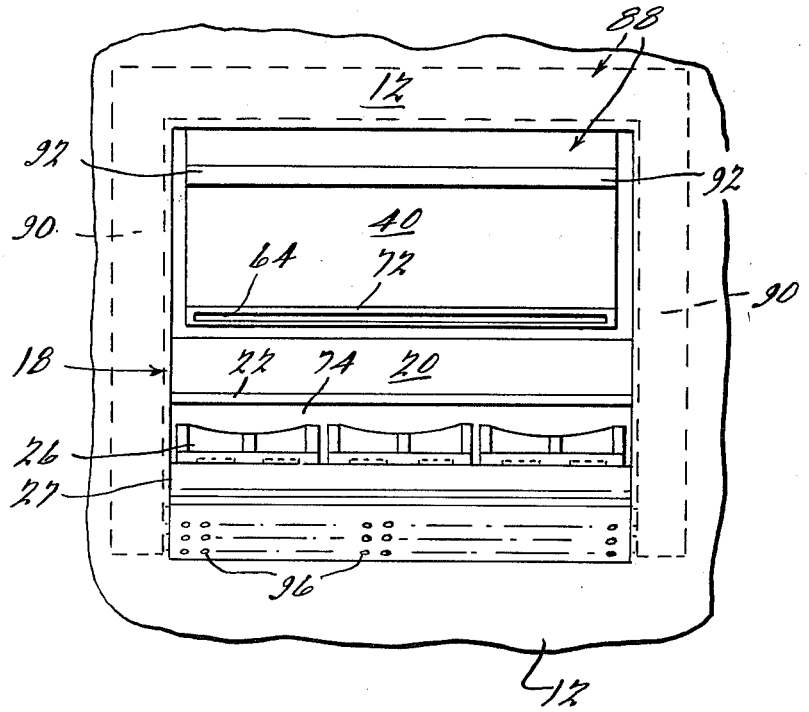
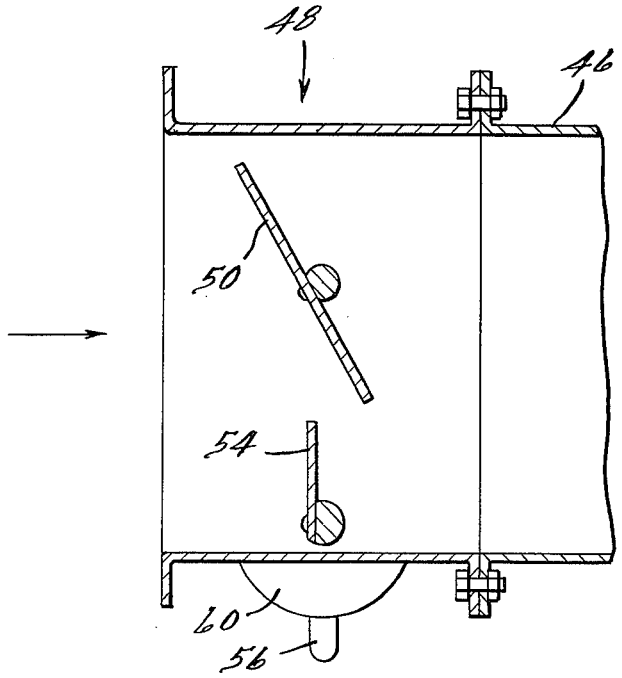
FIG. 5

MULTI-FUEL FEEDER DISTRIBUTOR

BACKGROUND AND SUMMARY OF THE INVENTION

The present invention relates generally to fuel feeders for stokers and more particularly to a new and improved multi-fuel feeder distributor that has the capability of feeding into a furnace and distributing over a grate coal and a second fuel, such as wood or a waste fuel, in combination or separately.

Prior art stokers which have the capability of feeding into the furnace and distributing over a grate coal and a second fuel in combination or separately have generally comprised two or more separate feeders at separate feed points. U.S. Pat. No. 2,228,751 (Bros), does disclose a fuel feeder which feeds a refuse fuel and coal at a single feed point, but the Bros device has several disadvantages. In the Bros device, the fuel is mixed prior to being thrown into the furnace chamber by the rotor. The size and weight of refuse fuel and coal are rarely the same. The rotor speed used in the Bros device would have to be an average speed and would not be correct for either fuel at the throw. Packing in the rotor housing will occur as the lighter refuse fuel, usually moist, is mixed at the rotor with the coal. Also, the mixing of the refuse and the coal prior to throw may cause an incorrect coal distribution on the grate due to the lighter fuel agglomerating on the pieces of coal or with other refuse fuel. Since an even coal bed is essential to efficient combustion in the stoker, such a problem is very significant in stoker fuel feeding applications. Other distinguishing features will be illustrated in the following specification and drawings.

One object of the present invention is to feed a second fuel, such as wood, bagasse, bark, municipal refuse, any other cellulose or waste fuel, or other fine, dry particulate fuels, in combination with coal into a furnace onto a grate, while at the same time not interfering with the coal feed providing a uniform coal bed for efficient combustion on the grate.

Another object is to provide separate control of the coal feed and the second fuel feed to permit optimum usage efficiency and flexibility of the stoker.

Combining the feeders into one opening not only requires fewer feeder openings into the furnace, but also provides the advantage of lower furnace air leakage. Additionally, the capital cost of converting a stoker having the capability of feeding only one fuel into a multi-fuel stoker is significantly less with the present invention, since both fuels are fed through the same opening into the furnace, this opening being approximately at the same location and of the same size as that required for a standard coal feeder when coal is the only fuel.

A further object is to provide a multi-fuel feeder having minimum furnace air leakage and a potential for lower positioning of the feeder relative to conventional feeders. A lower position would provide better fuel distribution over the grate surface of a stoker and better potential use of furnace volume.

The waste fuel feeding portion of the feeder consists of a chute for conveying the fuel by gravity to an air swept distributor spout and has several advantages independent of the multi-fuel combination. The waste fuel chute includes a counterbalanced damper which has the object of aiding in the distribution of the waste fuel, no matter how fine, across the width of the chute, which damper also serves as a back draft damper to prevent blow back from the furnace to the fuel storage system. Also, the damper may be positioned to completely close the waste feed chute if only coal is fed to the multi-fuel feeder distributor.

The damper plate is adjustable and can be locked in a fixed position to result in a narrow venturi throat. A further advantage of the present invention occurs when the feeder is used in this capacity to feed fine, dry fuels. Auxiliary steam jets are included to increase the velocity of the fine, dry fuel through the venturi throat to prevent blow back and assure injection of the fuel into the furnace faster than flame can propagate up the chute.

The air swept spout also supplies energy to feed the fuel over the entire grate from front to rear and side to side and has the further object of preventing sticking and plugging of the fuel in the chute.

The refuse chute spout includes a distribution air discharge slot at the discharge point where the fuel leaves the spout to enter the furnace. This air stream provides the advantage of accelerating the fuel entering the furnace to improve distribution of the fuel over the grate and advance the fuel to the opposite portion of the furnace.

A further object of the invention resides in the use of water cooling at the hopper feed throat to reduce the reflected heat from the furnace to protect the feeder parts from damage and reduce the potential of heat blow back into the chute.

Additional advantages of the present invention include a multi-air distribution system with deflector dampers to allow adjustment of distribution of the fuel and a continual variable air flow by means of a rotating damper, having a minimal air flow adjustment capability, to give variable distribution of waste fuel into the furnace onto an even bed of coal.

Other objects and advantages of the instant invention will be apparent in the following specification, claims and drawings.

BRIEF DESCRIPTION OF THE DRAWINGS

FIG. 3 is an enlarged vertical sectional view of the throat area of the feeder of FIG. 1;

FIG. 4 is an elevated rear view of the feeder of FIG. 1 assembled onto the wall of a stoker;

FIG. 8 is an elevated front view of FIG. 6.

DETAILED DESCRIPTION OF THE PREFERRED EMBODIMENTS

Figure 1:
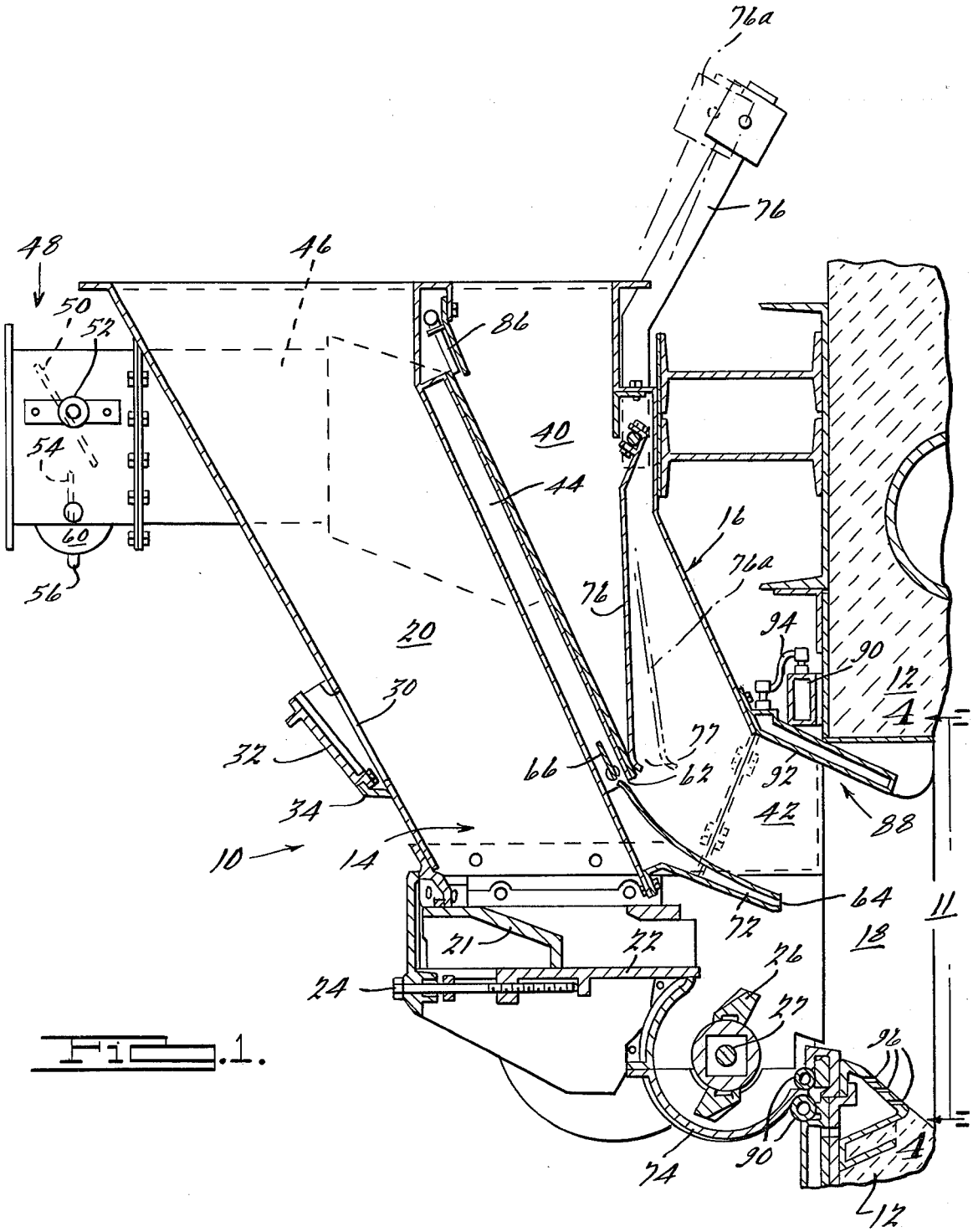
FIG. 1 is a vertical sectional view of a multi-fuel feeder distributor assembly of the present invention.
Figure 2:
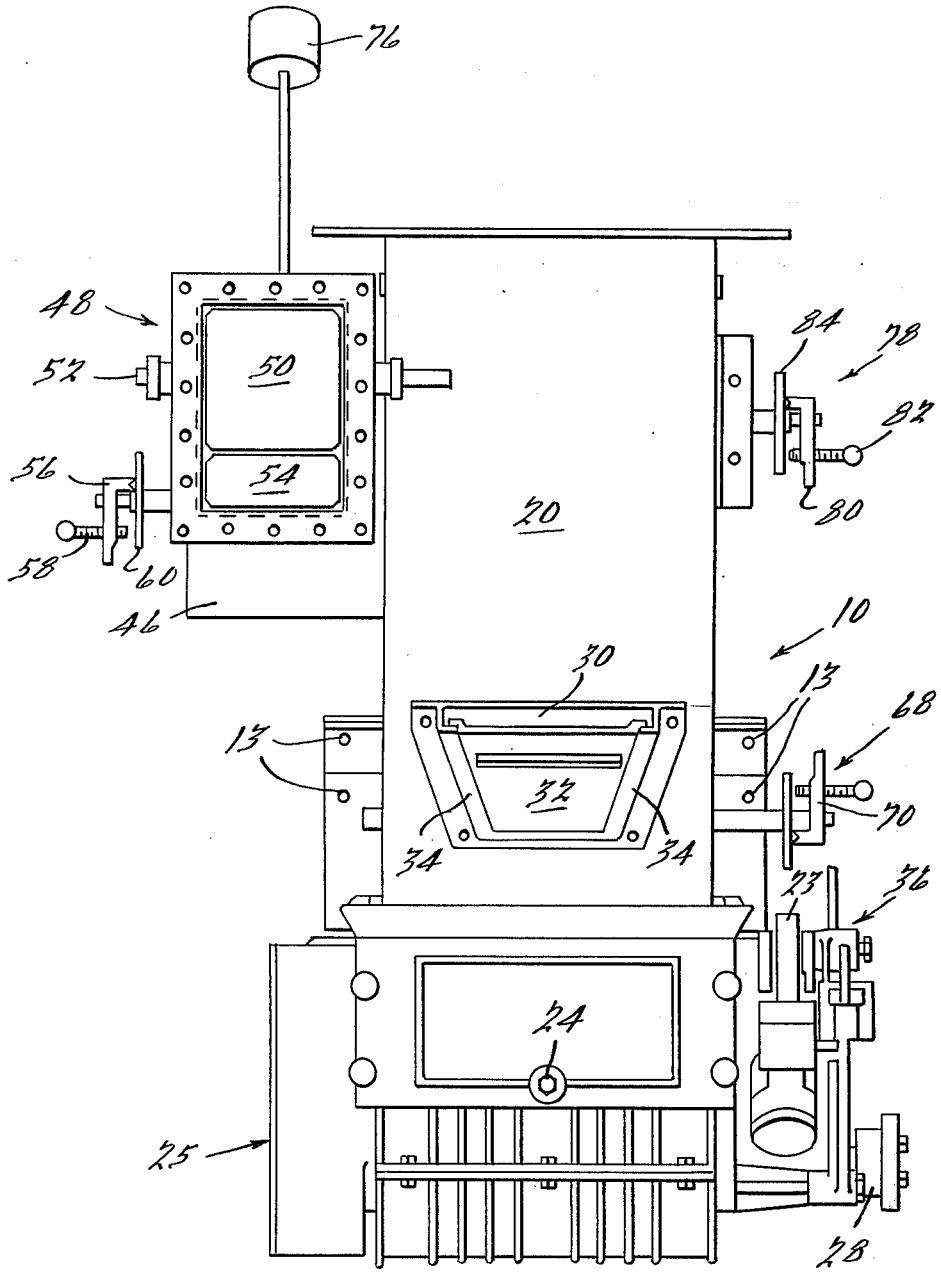
FIG. 2 is an elevated front view of the feeder of FIG. 1.
Figure 2:
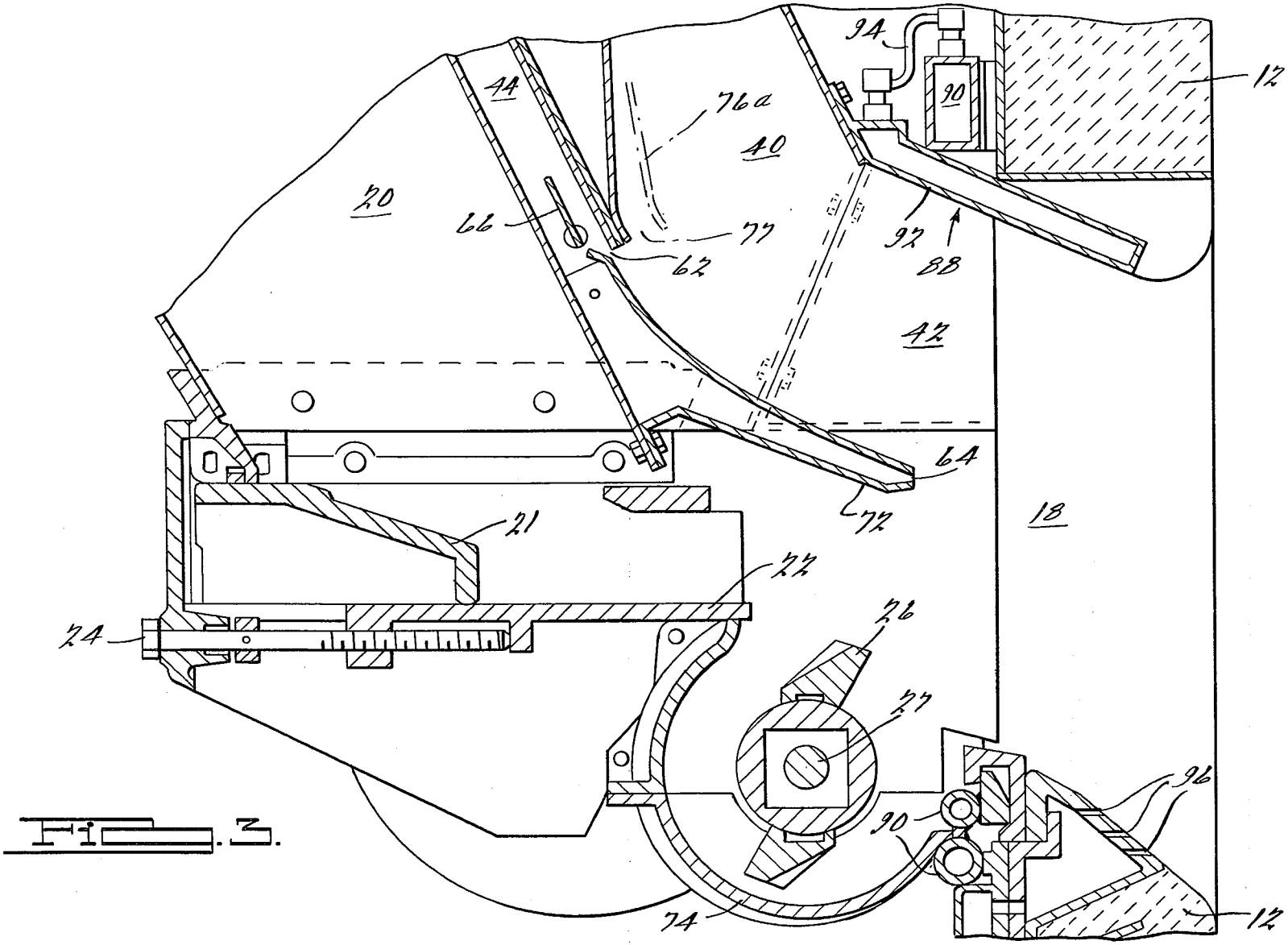

Referring now to FIGS. 1 and 2, an improved multi-fuel feeder distributor 10 is illustrated connected to the furnace wall 12 of a stoker furnace 11 by means of fasteners 13. The multi-fuel feeder distributor 10 includes generally coal feed means 14 and waste fuel feed means 16, capable of feeding wood, bagasse, municipal refuse, any other cellulose or waste fuel, or coal dust or other fine, dry fuels. The feeds 14 and 16 may be used either in combination or separately. The feeds 14 and 16 share a common feed throat 18, as seen in FIGS. 1, 3 and 4, to allow for a minimum of capital expense in either converting a single fuel fed stoker or originally constructing a multi-fuel fed stoker and lower furnace air leakage due to fewer feeder openings into the furnace.

More specifically, the coal feed means 14 comprises a coal hopper 20 fed and controlled from above, having shut-off means above the hopper (not shown). The hopper 20 directs the coal to a stationary spilling plate 22. A feed plate 21 adjacent to the spilling plate 22 is reciprocated by eccentric drive means 23 to spill coal onto a throw rotor 26 driven along shaft 27 by drive means 28. The eccentric drive means 23 driving the feed plate 21 is also driven by drive means 28 through transmission means 25. The plate 22 has an adjustment screw 24 to place the plate in the position of optimum feed into the rotor 26, which position may vary with the rotor speed, the amount of fuel desired to be fed, the grate dimensions, and other factors known to those skilled in the art. A pokehole 30 with a pokehole slide 32 and frame 34 attached to the hopper 20 is also provided to permit access to the coal in the hopper to break up the coal if fusing or any other hindrance to uniform flow occurs or for whatever other reason access is deemed necessary.

The coal feed 14 has a control mechanism 36 to control the stroke of the eccentric 23 and thus the coal feed rate. The control mechanism is usually operated from a remote location.

Figure 5:
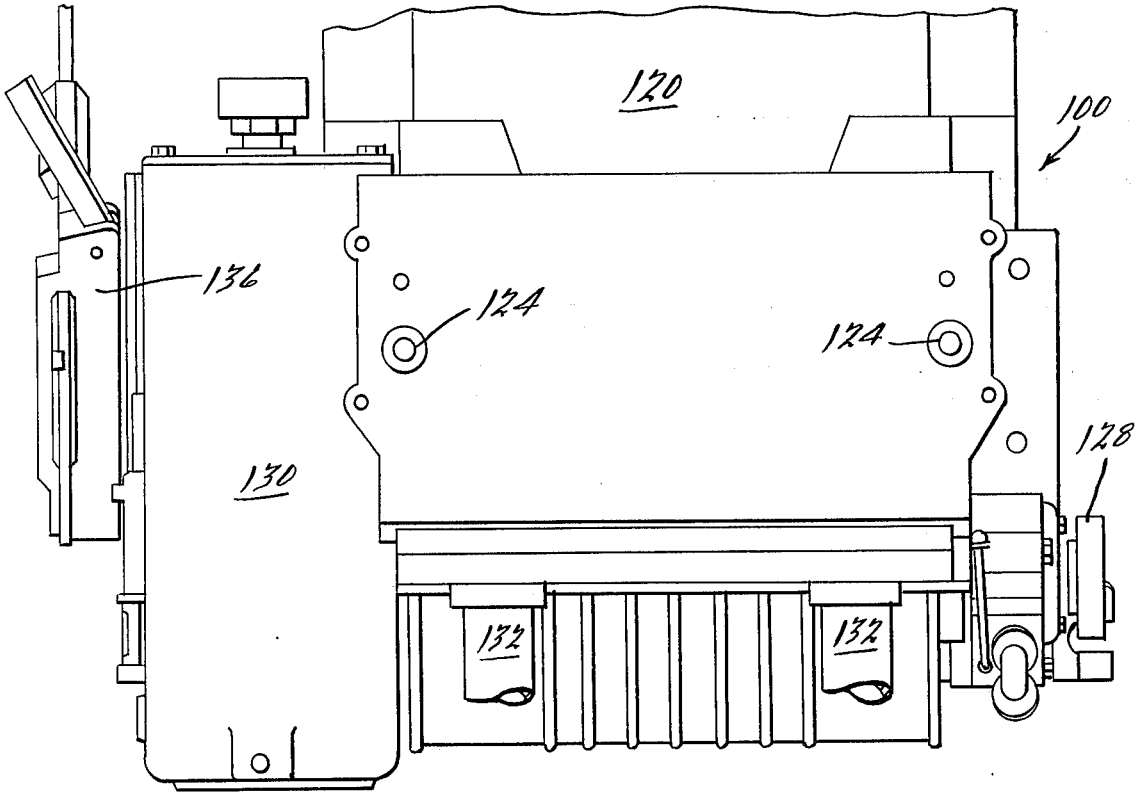
FIG. 5 is an enlarged vertical sectional view of the air supply system of FIG. 1 illustrating the operation of the rotary damper.
Figure 6:
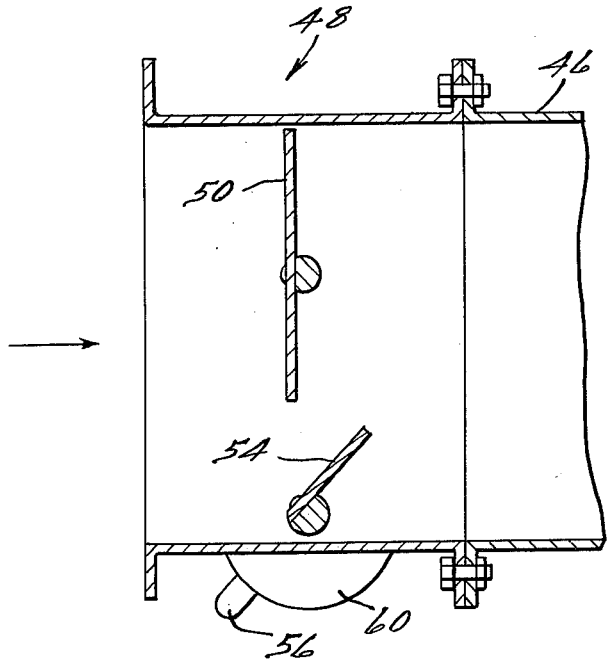
FIG. 6 is a view similar to FIG. 5 illustrating the operation of the minimum flow damper.

The second fuel feed means 16 is disposed essentially between the furnace wall 12 and the coal feed means 14. The fuel feed 16 includes a feed chute 40 having a spout 42 coincident with the feed throat 18 of the furnace wall 12. An air chamber 44 is located between the coal hopper 20 and the fuel chute 40 which is supplied with pressurized, forced draft air through a duct 46. Between the air supply and the air chamber 44 is disposed air control means 48, comprising a motorized rotary damper 50, having drive means 52, to drive the damper 50 between positions of maximum and minimum air flow, and a minimum air flow damper 54, controlled by a lockable handle 56. When the rotary damper 50 is used (FIG. 5), varying or pulsating air will be supplied to the air chamber 44. Alternatively, if varying air is not desired, the rotary damper 50 is stopped in a minimum air flow position, perpendicular to the longitudinal plane of the duct 46 in the described embodiment and closing off the duct 46 (FIG. 6). The amount of forced draft air desired would then be controlled by varying the position of the minimum flow damper 54 with the vertical, as illustrated in FIG. 6. The damper 54 may be secured in any position by moving the damper to the desired position and then turning the threaded stop 58 of the handle 56 into secure engagement with the handle plate 60. Indicators may be illustrated on the handle plate 60 to identify the various positions of the damper 54.

The air chamber 44 has two air outlets. The first is a sweeping air vent 62 located at a midpoint of the feed chute 40. Air supplied by the vent 62 aerates the waste fuel and also aids the gravity-fed fuel into the furnace to provide the energy to feed the fuel to the rear of the stoker grate and to prevent sticking and plugging of the fuel in the chute. A second vent for air chamber 44 is the distribution air discharge slot 64 located at the edge of the spout 42 of the waste fuel feed chute 40 where the fuel leaves the spout 42 to enter the furnace. This air stream is used to accelerate the fuel entering the furnace to improve distribution over the grate and get it to the rear of the furnace.

A proportioning damper 66 is included in the air chamber 44, having control means 68, with lockable handle 70, to adjust the proportion of the total air flow going to vent 62 and discharge slot 64. In combination with the motorized rotating damper 50, the air flow and the pressure thereof can be increased and decreased in a varying manner to provide variation in the distribution of the refuse fuel across the entire grate or hearth from front to rear. If a smooth, even flow of waste fuel is desired, the rotary damper 50 may be stopped in the minimum air flow position and the air flow can be controlled by the minimum air flow damper 54. Thus, the distribution of the fuel can be modified by three different stimuli for four air controls, the rotary damper 50, the minimum flow damper 54, and the proportioning damper 66 for the swept air vent 62 and the air discharge slot 64.

The spout 42 has a portion 72 which extends beyond the rotor 26 of the coal feed means 14. With this construction, no waste fuel will be mixed with the coal prior to the coal being thrown into the furnace and will not interfere with the even bed of coal provided by the coal feed which is indispensable to efficient combustion on the grate of the stoker. Also, the disadvantages attendant to a device as disclosed by U.S. Pat. No. 2,228,751 (Bros), such as incorrect rotor speed, packing of the waste fuel in the rotor housing 74, and agglomeration of the waste fuel on pieces of coal when the waste fuel is mixed with coal prior to throw will not be encountered. The distribution of both the coal and the waste fuel each can be controlled to obtain the optimum combustion efficiency.

The waste fuel chute 40 also includes a counterbalanced damper 76 to aid in distributing the fuel across the width of the chute and serve as a back draft damper to prevent blow back from the furnace to the waste fuel storage area above the chute 40. The damper 76 has control means 78, comprising a handle 80 lockable in various positions by screwing the threaded stop 82 securely to the handle plate 84. The handle plate 84 has indicator means (not shown) to indicate the various positions of the damper 76. The damper 76 can be locked fully open or closed, or be locked in a fixed intermediate position **76*a* resulting in a narrow venturi throat 77 to allow feeding of fine, dry fuel without blow back from the furnace up the chute 40. When the feeder 16 is used in this fashion, auxiliary steam jets 86 are used to increase the velocity of the material through the venturi throat 77 to prevent blow back and to assure injection of the fuel into the furnace faster than flame can propagate up the chute 40**.

The feed throat 18 also has a water cooling system 88, comprising a water-cooled base plate or conduit 90 lining the periphery of the feed throat 18, a water-cooled feed throat plate 92 located across the upper edge of said feed throat 18, connecting lines 94 between the plates, and a conventional cooling water supply system (not shown) including a pump and conventional means to cool the water. The water cooling system 88 aids in protecting the feeder parts from damage caused by the reflected heat from the furnace. Cooling is also provided by several rows of air-cooled tuyeres 96 at the base of the feed throat 18, supplied with air by air supply means (not shown) which usually is a different air supply than that provided to duct means 46. The water-cooled feed throat in combination with the improved feed and distributor features of the multi-fuel feeder distributor makes it possible to place the feeders in a lower position above the stoker grate for better fuel distribution over the grate surface and better potential use of furnace volume resulting from the lower possible feeder position.

Figure 7:
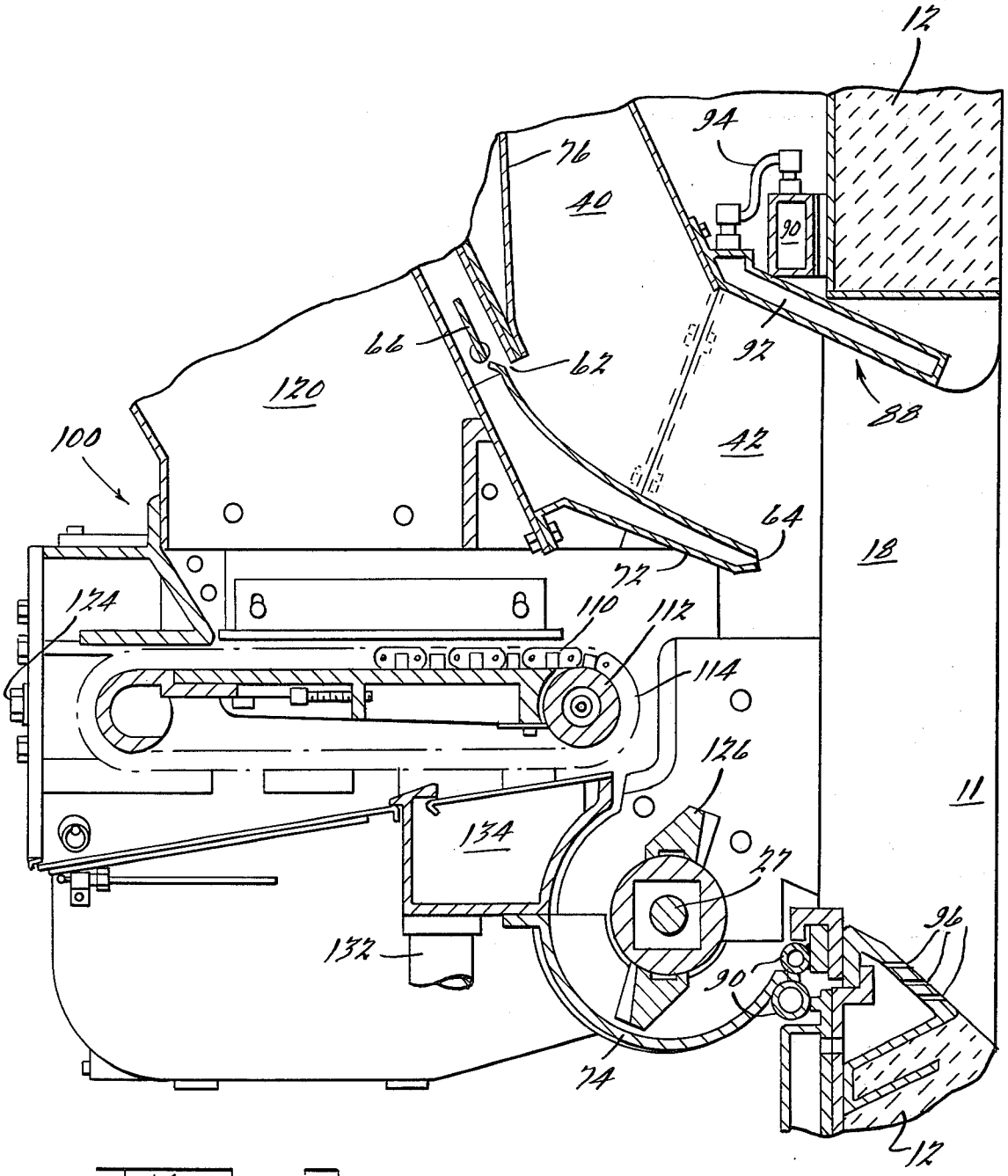
FIG. 7 is an enlarged view similar to FIG. 3 of an alternative embodiment of the present invention.

An alternative preferred embodiment of a multi-fuel feeder distributor of the present invention is illustrated in FIGS. 7 and 8. The feeder distributor 100 is generally identical to the feeder distributor 10 of FIG. 1. A chain driven conveyor 110, however, is used to spill coal from the coal hopper 120 to the rotor 126. The conveyor 110, although more expensive, supplies a more even amount of coal to the rotor 126 to increase the opportunity for an optimum even coal bed on the grate to provide optimum combustion efficiency while also reducing the possibility of plugging in the coal chute 120. The conveyor 110 is also driven by drive means 128 through reduction gear transmission means located in housing 130 which is controlled by control mechanism 136. Adjustment screws 124 may be provided to permit the spill 114 of the conveyor 110 to be placed at an optimum position above the throw of the rotor 126. Air is supplied by air supply means (not shown) through ducts 132 into chamber 134 as an added feature of this alternative embodiment to provide additional cooling to coal feed means and also blow fine coal particles into the furnace 11. The air supply means may also supply air to the air-cooled tuyeres 96 used to cool the base of the feed throat 18.

An illustrative embodiment of the invention which fully and effectively accomplishes the objects thereof is herein disclosed in the above description and in the drawings. However, it will be apparent that variations in the details of the apparatus may be indulged in without departing from the sphere of the invention herein described, or the scope of the appended claims.

What is claimed is:

1. A multi-fuel feeder for a stoker including a furnace, comprising:

a throat through which waste fuel and coal are fed into the furnace of the stoker;

coal feed means including a rotor for throwing coal through said throat into said furnace; and waste feed means for feeding waste fuel through said throat into said furnace along a path in said throat spaced from the path of coal from said rotor, whereby all mixing of said coal and said waste fuel occurs in said furnace.

2. A feeder in accordance with claim 1, wherein said coal feed means and said waste fuel feed means are controlled separately.

3. A multi-fuel feeder for a stoker comprising:

a throat through which waste fuel and coal are fed to the stoker;

coal feed means discharging into said throat and having a rotor to throw coal into said stoker; and means for feeding waste fuel through said throat along a path spaced from said rotor of said coal feed means, said waste fuel feed means comprising, a feed chute, having an inlet and a spout feeding into said throat;

air supply means; and vent means connected to said air supply means and located in said feed chute between said inlet and said spout in the direction of said spout.

4. A feeder in accordance with claim 3, further comprising duct means located between said air supply means and said vent means; and rotary damper means and minimum flow damper means located within said duct means.

5. A feeder in accordance with claim 4, wherein both said rotary damper means and said minimum flow damper means have a closed position in the same plane.

6. A multi-fuel feeder for a stoker comprising:

a throat through which waste fuel and coal are fed to the stoker;

coal feed means discharging into said throat and having a rotor to throw coal into said stoker;

means for feeding waste fuel through said throat along a path spaced from said rotor of said coal feed means, said waste fuel feed means comprising, a feed chute, having an inlet and a spout feeding into said throat;

air supply means; and vent means connected to said air supply means and located in said feed chute between said inlet and said spout in the direction of said spout; and a counterbalanced damper extending across the feed chute and means to set said damper at any position across said feed chute to form a venturi throat across said feed chute.

7. A feeder in accordance with claim 6, wherein said vent means is located downstream of the counterbalanced damper.

8. A feeder in accordance with claim 7, further comprising steam jets located upstream of said damper in said feed chute to aid in the feeding of fine, dry fuel through said damper when positioned as a venturi throat.

9. A feeder in accordance with claim 8, further comprising air discharge port means located at said spout, connected to said air supply means, and directed outwardly from said spout to provide air to aid in the distribution of fuel fed into said stoker.

10. A feeder in accordance with claim 9, further comprising duct means, connecting said vent means and said discharge port means to said air supply means; and proportional damper means within said duct means to control the air flow to both said vent means and discharge port means.

11. A feeder in accordance with claim 10, wherein said proportional damper means comprises only one damper.

12. A feeder in accordance with claim 11, wherein said feed throat has cooling means disposed on at least a portion of the periphery thereof.

13. A feeder in accordance with claim 12, further comprising air control means located in said duct means and connected to said air supply means upstream of said proportional damper means, comprising:

rotary damper means to provide said vent means and discharge port means with varying air and having a closed position perpendicular to the longitudinal plane of said duct means; and minimum flow damper means to control the air supply when said rotary damper means is in said closed position.

14. A feeder in accordance with claim 13, wherein both said rotary damper means and said minimum flow damper means have a closed position in the same plane.

15. A feeder in accordance with claim 1, wherein said feed throat has cooling means disposed on at least a portion of the periphery thereof.

16. A feeder for a stoker having waste fuel feed means, having air control means to provide air to be used in feeding fuel through said waste fuel feed means into said stoker, said air control means comprising:

duct means attached to said feed means;

air supply means;

rotary damper means driven between maximum and minimum air flow positions for providing said feed means with pulsating air from said air supply through said duct means; and minimum flow damper means to control the air supply through the same said duct means when said rotary damper means is in said position of minimum air flow, wherein said rotary damper means and said minimum flow damper means control the air flow through the same duct means supplying air to said feed means.

17. A feeder in accordance with claim 16, wherein both said rotary damper means and said minimum flow damper means have a closed position in the same plane.

18. A feeder for a stoker having a furnace and waste fuel feed means comprising:

a feed chute having an inlet point and a discharge point;

a counterbalanced damper extending across said feed chute upstream of said discharge point; and means to set said damper at any position across said feed chute to form a venturi throat across said feed chute upstream of said discharge point to allow feeding of fine, dry fuel without blow back from said stoker furnace.

19. A feeder in accordance with claim 18, further comprising steam jets located upstream of said damper to aid in the feeding of fine, dry fuels through said damper when positioned as a venturi throat.

20. A feeder for a stoker having waste fuel feed means comprising:

a feed chute;

a counterbalanced damper extending across said feed chute;

means to set said damper at any position across said feed chute to form a venturi throat across said feed chute; and vent means located downstream of said damper and air supply means for said vent means to provide sweeping air in said feed chute.

21. A feeder in accordance with claim 18, wherein said feed chute further comprises: a spout; discharge port means located at said spout and directed outwardly from sid spout; and air supply means, to provide air to said port means to aid in the distribution of fuel fed into said stoker.

22. A feeder for a stoker having waste fuel feed means comprising:

a feed chute comprising a spout, discharge port means located at said spout and directed outwardly from said spout, and air supply means, to provide air to said port means to aid in the distribution of fuel fed into said stoker;

a counterbalanced damper extending across said feed chute;

means to set said damper at any position across said feed chute to form a venturi throat across said feed chute; and vent means located downstream of said damper.

23. A feeder in accordance with claim 22, having proportional damper means to control the air flow to both said vent means and said discharge port means.

24. A feeder distributor for a stoker having waste fuel feed means, comprising:

a feed chute, having inlet means and a fuel discharge point;

air supply means;

vent means from said air supply means into said feed chute and between said inlet means and said fuel discharge point directed toward said discharge point, for providing swept air in the direction of said fuel discharge point; and air discharge means from said air supply means located at said fuel discharge point of said feed chute and directed outwardly for providing air to distribute said waste fuel into said stoker.

25. A feeder in accordance with claim 24, wherein said air supply means provides a varying air stream to said vent means and said air discharge means.

26. A feeder in accordance with claim 24, further comprising duct means located between said air supply means and said air chamber; and rotary damper means and minimum flow damper means located within said duct means.

27. A feeder in accordance with claim 26, wherein both said rotary damper means and said minimum flow damper means have a closed position in the same plane.

28. A multi-fuel feeder for a stoker including a furnace and a grate disposed in said furnace, comprising:

a feed passage for fuel into said furnace;

means for feeding coal along a path through said feed passage into said furnace having a fuel discharge point in said feed passage, and being combusted only after entering the furnace; and means separate from said coal feed means for feeding waste fuel through the same feed passage into said furnace along a path spaced from the path of coal from said coal feeding means in said feed passage, having a fuel discharge point located at substantially the same position in the feed passage as said coal feed means discharge point, whereby substantially all mixing of said coal and said waste fuel occurs in said furnace.

29. A feeder in accordance with claim 28, wherein said waste fuel feed means discharge spout is located directly above said coal feed means discharge spout.

30. A feeder in accordance with claim 24, further comprising proportioning damper means to control the air flow to both said vent means and said air discharge means.

* * * * *